US010856640B2

(12) United States Patent
Killips

(10) Patent No.: US 10,856,640 B2
(45) Date of Patent: Dec. 8, 2020

(54) ILLUMINATED FAKE NAIL TIP

(71) Applicant: Christopher G Killips, Vancouver (CA)

(72) Inventor: Christopher G Killips, Vancouver (CA)

( * ) Notice: Subject to any disclaimer, the term of this patent is extended or adjusted under 35 U.S.C. 154(b) by 345 days.

(21) Appl. No.: 15/976,785

(22) Filed: May 10, 2018

(65) Prior Publication Data

US 2018/0325235 A1 Nov. 15, 2018

Related U.S. Application Data

(60) Provisional application No. 62/528,316, filed on Jul. 3, 2017.

(30) Foreign Application Priority Data

May 10, 2017 (CA) ..... 2966390

(51) Int. Cl.

| | |
|---|---|
| ***A45D 31/00*** | (2006.01) |
| ***F21V 31/00*** | (2006.01) |
| ***F21V 33/00*** | (2006.01) |
| *F21Y 115/10* | (2016.01) |
| *F21L 4/00* | (2006.01) |
| *F21V 23/04* | (2006.01) |

(52) U.S. Cl.

CPC ..... *A45D 31/00* (2013.01); *F21V 31/005* (2013.01); *F21V 33/0004* (2013.01); *A45D 2200/20* (2013.01); *F21L 4/00* (2013.01); *F21V 23/0414* (2013.01); *F21Y 2115/10* (2016.08)

(58) Field of Classification Search

CPC .. A45D 31/00; A45D 2200/20; F21V 31/005; F21V 33/0004; F21V 23/0414; F21Y 2115/10; F21L 4/00

USPC ..... 132/200

See application file for complete search history.

(56) References Cited

U.S. PATENT DOCUMENTS

| | | | | |
|---|---|---|---|---|
| 4,751,935 | A * | 6/1988 | Mast | A45D 31/00 132/73 |
| D303,161 | S * | 8/1989 | Tomkins | D28/56 |
| D413,183 | S * | 8/1999 | Drake | D28/56 |
| 6,908,206 | B1 * | 6/2005 | Pinciaro | A41D 27/085 362/34 |
| 7,703,937 | B2 | 4/2010 | Shirey | |
| 8,689,806 | B2 | 4/2014 | Tufts | |
| 8,975,606 | B2 | 3/2015 | Bowers | |
| 9,060,585 | B1 * | 6/2015 | Tran | A45D 34/04 |
| 2002/0112734 | A1 * | 8/2002 | Rambeau | A45D 31/00 132/73 |
| 2007/0295349 | A1 * | 12/2007 | Simpson | A45D 31/00 132/73 |
| 2009/0293896 | A1 * | 12/2009 | Simpson | A45D 31/00 132/73 |
| 2014/0246037 | A1 * | 9/2014 | Drake | F21V 33/0004 132/73.5 |

(Continued)

*Primary Examiner* — Nicholas D Lucchesi

(57) ABSTRACT

A light source and a power source are held between upper and lower shells of a fake nail tip. The fake nail tip is provided with its shells hinged open and the light source unactivated. As the shells are brought together, an electrical contact is made between the power source and the light source, which causes the light source to illuminate the fake nail tip. The shells are then fastened together to maintain the light source illuminated.

20 Claims, 6 Drawing Sheets

(56) References Cited

U.S. PATENT DOCUMENTS

| | | | | |
|---|---|---|---|---|
| 2015/0213352 | A1* | 7/2015 | Niedermann | G06K 19/0723 132/73 |
| 2016/0295989 | A1* | 10/2016 | Hakeem | A45D 44/005 |
| 2019/0223575 | A1* | 7/2019 | Cephus | A44C 15/0015 |
| 2019/0301725 | A1* | 10/2019 | May | A44C 15/009 |

* cited by examiner

ILLUMINATED FAKE NAIL TIP

CROSS-REFERENCE TO RELATED APPLICATIONS

This application claims the benefit of U.S. provisional patent application Ser. No. 62/528,316, filed on Jul. 3, 2017, and Canadian patent application no. 2,966,390, filed on May 10, 2017, both of which are incorporated by reference herein in their entirety.

TECHNICAL FIELD

This application relates to fake nail tips. More specifically, it relates to a method and system for the illumination of fake nail tips.

BACKGROUND

Fake nail tips are commonly used in the beauty industry and it has been a standard feature of fake nail tips, since their first inception in 1954 by Dr. Fred Slack, that they be thin and mimic the shape of an actual person's fingernail.

Examples of prior art include: a) light sources in small eraser sized boxes that attach to a person's finger through the use of elastic bands and b) a glove, also known as a rave glove, that has been fitted with batteries and lights that wearers can manually activate and put on their hands. Though these devices perform their intended purpose well, they are cumbersome to use and operate, require a lot of components and a substantial power supply, as well as being limited in their range of applications due to the specific activities that they were designed for. Furthermore, these devices are usually not suitable for aesthetical purposes.

U.S. Pat. No. 8,975,606 to Bowers embodies a finger-mounted illuminating device that addresses the problem of maintaining hands-free capability in a low or no light environment. The invention has for its main purpose the illumination of the immediate environment of the hand. Thus, the conception of the device does not relate to the mimicry of the shape of the wearer's hand or fingers.

U.S. Pat. No. 8,689,806 to Tufts et al. embodies an artificial nail covered by an electroluminescent material film connected to an electrical circuit by means of a driver module. The driver module is used to modulate the voltage applied to the electroluminescent film. The electroluminescent material is not positioned inside the artificial nail but on its surface.

This background information is provided to reveal information believed by the applicant to be of possible relevance to the present invention. No admission is necessarily intended, nor should be construed, that any of the preceding information constitutes prior art against the present invention.

SUMMARY OF INVENTION

The present application is directed to a device which mimics the shape of a natural human nail and encloses both a light source and power source. The light source is activated as the two shells of the fake nail tip are closed together. The fake nail tip conceals, to various degrees, its circuitry and components. The shape and aesthetical feature of the fake nail tip may be chosen in regards to being mounted properly on a natural nail. Various light effects and/or patterns may be included in the fake nail tip.

The attributes of the embodiments of the invention resolve one or more of the prior art technical issues in the way that the components of the fake nail tip are thin, light, flexible, are few in number, and are easy to operate. As a result of the illumination of the fake nail tip, it is possible to extend the scope of aesthetic applications for fake nail tips.

Disclosed herein is a fake nail tip for a human fingernail or toenail, comprising a light source mounted in the fake nail tip, a power source mounted in the fake nail tip and connected to the light source, and a diffuser around the light source.

Further disclosed herein is a method of illuminating a fake nail tip comprising the steps of mounting a light source in the fake nail tip, mounting a power source in the fake nail tip, connecting the power source to the light source, and providing a diffuser in the fake nail tip around the light source.

Still further disclosed is a kit of ten fake nail tips, each fake nail tip comprising a light source mounted in the fake nail tip, a power source mounted in the fake nail tip and connected to the light source, and a diffuser around the light source.

BRIEF DESCRIPTION OF DRAWINGS

The following drawings illustrate embodiments of the invention and should not be construed as restricting the scope of the invention in any way.

DESCRIPTION

A. Glossary

The term "fake nail tip" refers to an extension that is fixed, usually adhered, onto the upper surface of a human nail. This is in comparison to fake nail forms, which are adhered to the underside of the projecting or overhanging part of the nail.

The term "illumination device" refers to a device that is capable of producing and emitting light when it is activated by electricity.

The term "battery", in the electrical field, refers to a device that has one or more electrochemical cells and is able to store chemical energy in order to make it available in an electrical form.

The term "spot welding" refers to a process in which contacting points of two metal surfaces are joined by the heat created by resistance to electric current. Plastic components may also be spot welded, and the welds may referred to as micro-welds if they are particularly small.

The terms "distal" and "proximal" refer to the distance of a body part, component or feature in regards to its proximity to the center of the body or device of which it is part. The term "distal" describes a part that is situated away from the point of attachment or origin of the part, while "proximal" describes a part next to, or relatively closer to, the point of attachment.

B. Exemplary Embodiments

Figure 1:
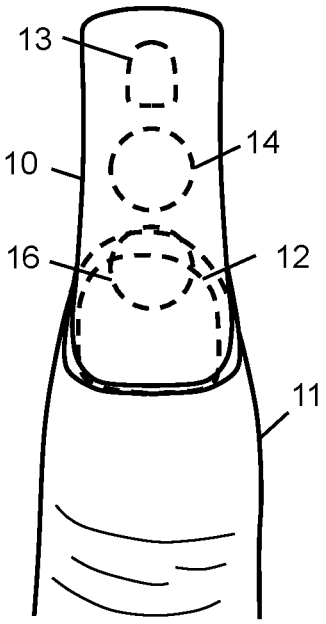
FIG. 1 is a drawing showing an assembled fake fingernail tip according to an embodiment of the present invention, mounted on a finger as seen from above.

Referring to FIG. 1, there is shown an exemplary embodiment of the fake nail tip 10 mounted on a finger 11 that has a natural nail 12. The fake nail tip 10 is mounted using glue on top of the natural nail 12. In various other embodiments, the fake nail tip 10 is dimensioned to be mounted on a toenail. The glue used to position the fake nail tip 10 on the natural nail 12 may be, for example, a cyanoacrylate type adhesive such as the type found in most fake nail kits.

An illumination device 13 is positioned in the overhanging part of the fake nail tip 10. In some embodiments, the illumination device 13 when activated may exhibit, for example, one or several illumination patterns. The position of the illumination device 13 may be in a different location in the fake nail tip 10 in other embodiments. The material used for the fake nail tip 10 may be polymer, acrylic or hard gel and may show various degrees of translucency or transparency depending on the diffusing capacity of the chosen material. The illumination device 13 may provide, for example, graduated intensity, various colors, colors that switch and/or blinking patterns. The top surface of the fake nail tip 10 may have reflective pieces of material of various sizes, such as glitter, which are able to reflect the light coming from the illumination device 13 located inside the fake nail tip 10 or the ambient light.

Two power sources 14, 16 are positioned in two cavities carved and located inside the fake nail tip 10. The dimensions of one power source may be, for example, 5 mm in diameter and 1 mm thick.

Various colors, patterns or graphic design may be applied to the top surface of the fake nail tip 10. The design and the shape of the fake nail tip 10 may be made in a such a way to mimic real nails. Alternately, the overall shape of the fake nail tip 10 may be square, squared oval, rounded, almond, ballerina or stiletto. The angles between the top edge and the side edges of the fake nail tip 10 may be more or less rounded. The shoulders of the fake nail tip 10 may be more or less flat.

The material of the fake nail tip 10 may exhibit various degrees of flexibility and thickness. For example, the material used for the fake nail tip 10 may be soft enough at its top edge to be shaped or cut.

As an example only, the fake nail tip 10 may be 3 cm long and 1 cm wide. It will be appreciated that many other dimensions are possible in other embodiments, particularly when a kit of fake nail tips are provided in a set for a single wearer.

Figure 2:
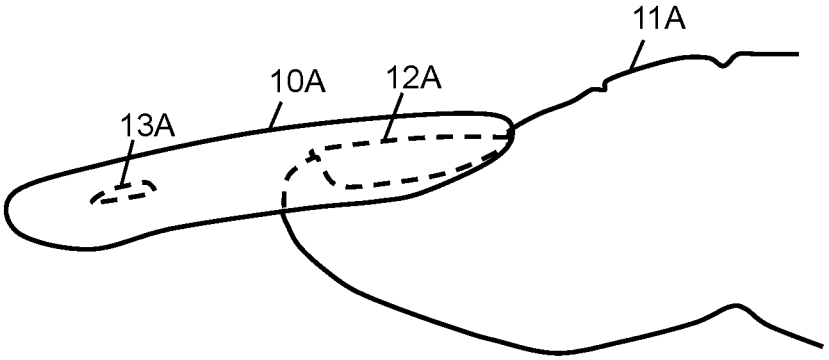
FIG. 2 is a drawing showing an assembled fake nail tip according to an embodiment of the present invention, mounted on a thumb as viewed from the side.

Referring to FIG. 2, there is shown an illustration of fake nail tip 10A mounted on a thumb 11A, glued to thumbnail 12A as seen from the side. In this embodiment, the shape of the fake nail tip 10 mimics and extends the shape of the natural nail 12A. The fake nail tip 10A exhibits a convex shape on its top surface, like a natural nail. The illumination device 13A is located in the overhanging part 18 of the fake nail tip 10A.

Figure 3:
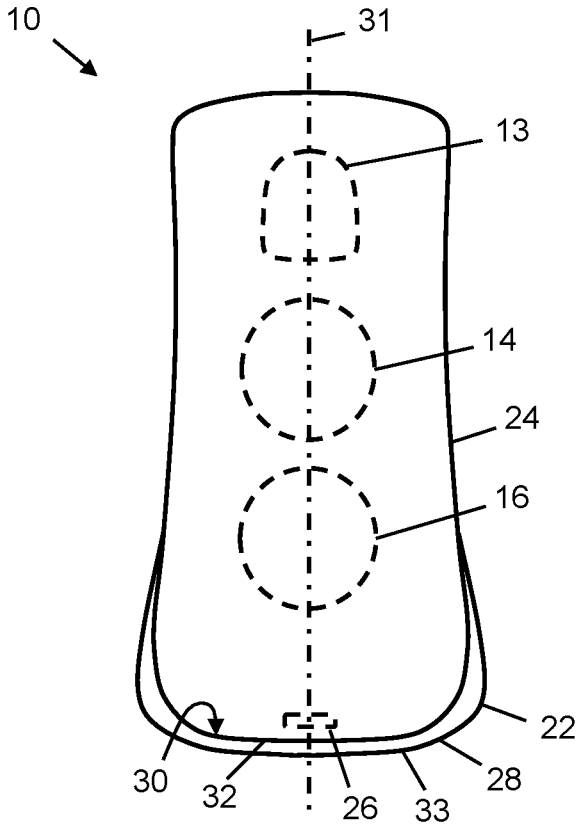
FIG. 3 is a drawing showing an assembled fake fingernail tip as seen from above, according to an embodiment of the present invention.

Referring to FIG. 3, there is shown an exemplary embodiment of the assembled fake nail tip 10 seen from above. The illumination device 13 and the two power sources 14,16 are hidden from view if the top surface of the fake nail tip 10 is opaque. However, the illumination device 13 and the two power sources 14,16 are visible through the material of the fake nail tip 10 if it is translucent. The body of the fake nail tip 10 includes a lower shell 22 and upper shell 24 joined by a plastic micro-weld spot 26 in the proximal regions of the upper and lower shells. The upper shell 24 almost covers all of the visible area of the lower shell 22. The weld spot may be, for example, about 2 mm long. In this embodiment, the lower surface of the upper shell 24 of the fake nail tip 10 is adapted to assist in housing and optionally concealing the illumination device 13 and power sources 14, 16 within the body of the fake nail tip 10. The upper shell 24 of the fake nail tip 10 is mechanically located in position on the lower shell 22. The proximal edge 33 of the lower shell 22 is flanged 28 in an upwards direction and extends out from under the upper shell 24 at its proximal edge 32 when the device is assembled. The distal edge 30 of the flange 28 of the lower shell 22 engages with the proximal edge 32 of the upper shell 24. In different embodiments, the power sources 14, 16 and the illumination device 13 are positioned inside the lower shell 22, inside the upper shell 24, or partially in both upper and lower shells.

The flange 28 is fitted onto a person's fingernail so that it butts up against the cuticle, the lower surface of the lower shell 22 conforming to the top surface of the fingernail 12. The top surface of the lower shell 22 is generally convex and constructed in such a way that it conforms to the generally concave lower surface of the upper shell 24. The surface of the upper shell 24 is convex with a thickness greater along, and near, the longitudinal centerline 31 of the fake nail tip 10, and tapers to a substantially thinner, tapered edge at the side perimeters of the fake nail tip.

Figure 4:
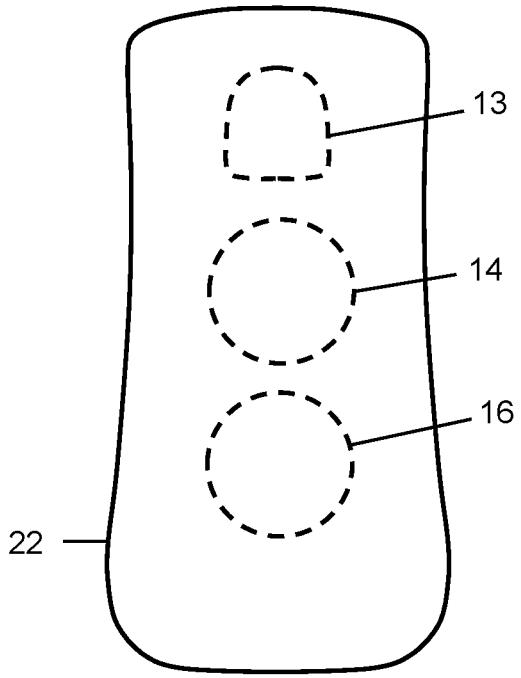
FIG. 4 is a drawing showing the assembled fake fingernail tip of FIG. 3, as seen from underneath.

Referring to FIG. 4, there is shown a view of the assembled fake fingernail tip 10 seen from underneath. The dashed lines show the embedded illumination device 13 and the embedded power sources 14, 16, which may be seen through the lower shell 22 depending on its translucency.

Figure 5:
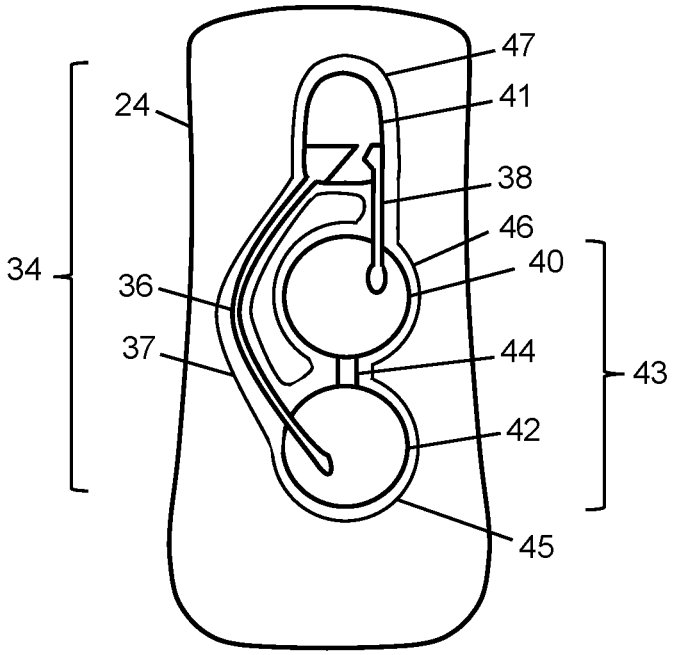
FIG. 5 is a drawing showing the upper shell of the fake fingernail tip of FIG. 3 with an illumination system, as seen from underneath.

Referring to FIG. 5, the upper shell 24 of the fake nail tip 10 with the illumination system 34 is shown from underneath. In this embodiment, the illumination source is an LED (light-emitting diode) 41 and the power sources are micro-batteries 40, 42. The micro-battery assembly 43, which includes the connected micro-batteries 40, 42, is fitted into a cavity 45 carved or molded into the lower surface of the upper shell 24, and is held in place using a standard rubber adhesive such as contact cement. The cavities 45, 46 for the micro-battery assembly 43 are aligned generally along the longitudinal centerline of the upper shell 24, approximately midway between its proximal and distal ends.

The anode post 36 of the LED 41 lies in channel 37 and is connected to the proximal battery 42 of the micro-battery assembly 43. The anode post 36 is flattened, more so at the end of the post than along its length, to allow for the correct thickness required for a micro-weld between the post and the positive terminal of the micro-battery 42, and so that it can be fitted into its respective cavity properly. The cathode 38 of the LED 41 is connectable to the distal micro-battery 40 of the micro-battery assembly 43. The cathode post 38 is short and free standing, i.e. unconnected to the micro battery when the micro-battery assembly is assembled into the upper shell 24. It is angled and positioned in such a way that permits a contact connection to be made between the negative terminal of the micro-battery 40 and the cathode post 38 when the two shells 22, 24 are fully closed. The two micro-batteries 40, 42 are connected in series by an electrically conducting tab 44 that is micro-spot welded, for example, to the micro-batteries. In some embodiments, the cavity 47 which houses the LED 41 in the distal section of the lower surface of the upper shell 24 of the fake nail tip 10 may also serve as a repository for the glue that is used to keep the device pinched shut. The micro-battery assembly 43, for example, may include one or more lithium micro-batteries or one or more alkaline batteries connected in series or parallel depending on the voltage requirement of the illumination source.

Figure 6:
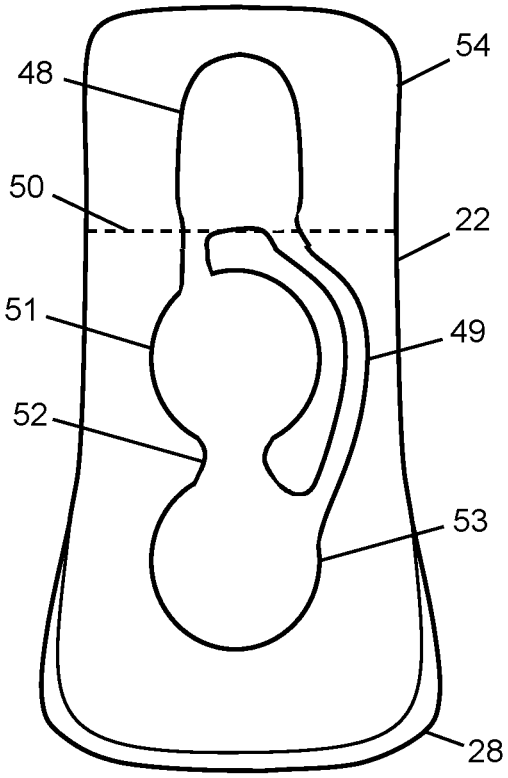
FIG. 6 is a drawing showing the lower shell of the fake fingernail tip of FIG. 3, as seen from above.

Referring to FIG. 6, there is shown the lower shell 22 of the fake nail tip 10 seen from above with the compartment 47 for holding the LED 41. The anode 36 of the LED 41 is connected to the micro-battery assembly 43 through a long narrow arced channel 49 positioned along one of the side shoulders of the lower shell 22. The two cavities 51 and 53 that encase the two micro-batteries 40 and 42 are connected by a conduit 52 positioned centrally. Henceforth the bottom surfaces of these cavities 48, 51, 53 act as closures for the corresponding cavities 47, 46, 45 in the upper shell 24. The conduit 52 holds the electrically conductive tab 44 that electrically connects the two micro-batteries 40, 42. In this embodiment, the area distal to the dashed line 50 represents a thicker part 54 of the lower shell 22 that fills in the concavity of the bottom surface of the lower shell 22. The thicker part is a diffuser, i.e. it is translucent in order to diffuse the light emitted from the LED 41. In some embodiments, the thicker part 54 can merge gradually into the overhanging part of the lower shell 22, rather than there being an abrupt transition between the two areas.

Figure 7:
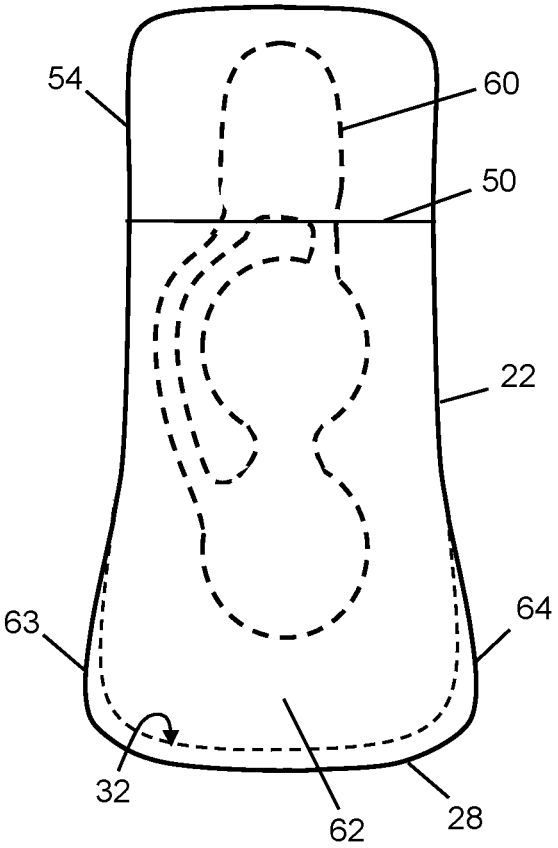
FIG. 7 is a drawing showing the lower shell of the fake fingernail tip of FIG. 3, as seen from underneath.

Referring to FIG. 7, the lower shell 22 of the fake nail tip 10 is seen from underneath. The dashed line 60 represents the receptacle that carries the LED 41, the two micro-batteries 40, 42, the anode 36 and the cathode 38. The dashed line in the proximal part of the lower shell 22 shows the distal edge 32 of the ridge 28 on the proximal end of the lower shell 22. The visible surface of the lower shell 22 is concave except for in its distal part 54 beyond boundary 50, where its surface is flat and substantially thicker in order to be able to house the LED 41. The thickness at the proximal part 62 of the of the lower shell 22 is, in some embodiments, paper thin in order to be easily mounted on the natural nail 12, and widens at the sides 63, 64 and the proximal edge to form the flange 28.

Figure 8:
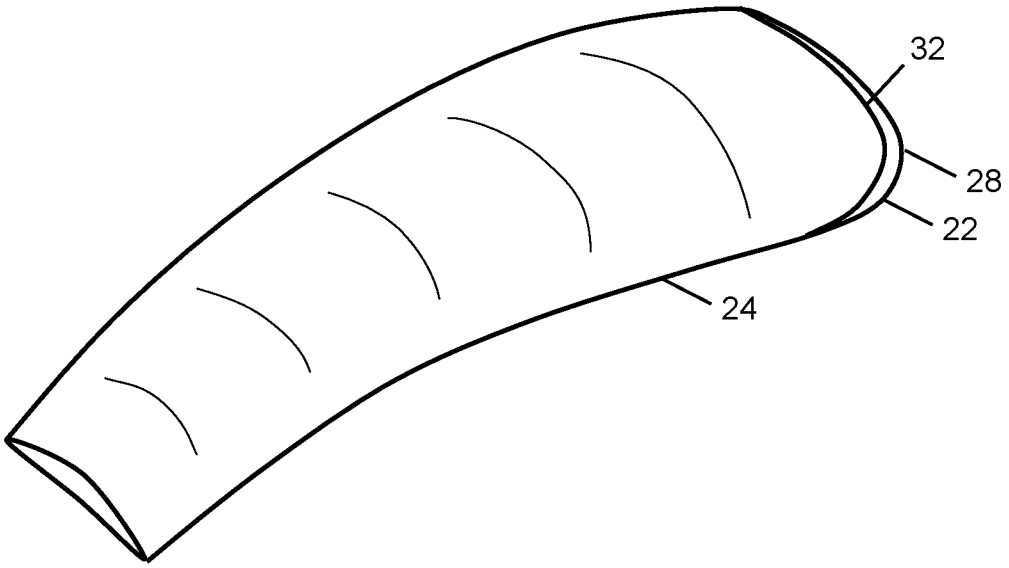
FIG. 8 is a drawing showing the assembled fake fingernail tip of FIG. 3, with the two shells closed together, seen from above and the side in a perspective view.

Referring to FIG. 8, an assembled fake nail tip 10 shows the lower shell 22 and the upper shell 24 permanently pinched together, using the flange 28 of the lower shell 22 to locate the proximal edge 32 of the upper shell 24. The upper shell's 24 bottom surface, which is concave, matches the lower shell's 22 convex top surface in order to be placed on top of it when the fake nail tip 10 is assembled and closed. The dimensions of the fake nail tip 10 are large enough to completely encapsulate the illumination source and the power source.

Figure 9:
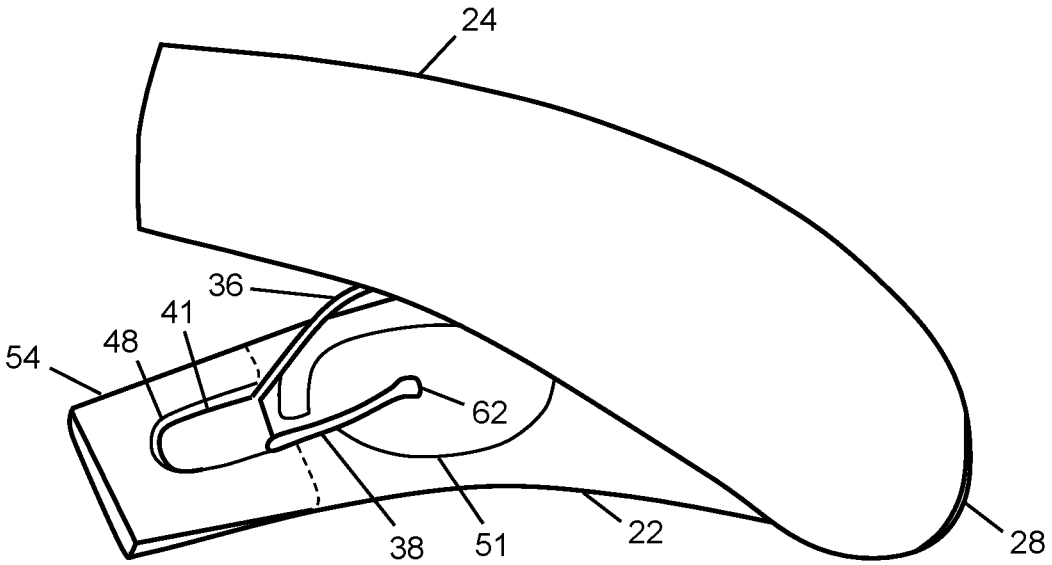
FIG. 9 is a drawing showing the assembled fake fingernail tip of FIG. 3, in its open, pre-activation state with the two shells connected at their proximal ends, seen from above and the side in a perspective view.

Referring to FIG. 9, an illustration of the fake nail tip 10 is shown, assembled in its open, pre-activation state prior to being pinched shut for activation. The two shells 22 and 24 are joined in their proximal regions near the ridge 28 by the plastic micro-spot weld 26 (not visible) and opened at the distal extremity in order to show in part the illumination system receptacle 48, 51 in the lower shell 22. The joint via the spot weld, together with the flexibility of one or both of the upper and lower shells, act as a hinge. The upper and lower shells 24, 22 are welded together before the illumination system 34 is inserted. A small drop of standard nail glue may be placed in the illumination device cavity 48 in order to seal and maintain pinched the two shells 22 and 24 of the fake nail tip 10. The anode post 36 is connected to the positive terminal of the micro-battery assembly 43, which is mounted in the upper shell 24. When the fake nail tip 10 is sealed, an electrical contact connection is established between the free end 62 of the cathode post 38 and the negative terminal of the micro-battery assembly 43 mounted in the upper shell 24, thus illuminating the fake nail tip 10. The LED 41 is positioned in the distal part of the lower shell 22 in the thicker, light-diffusing section 54. The cavity 51 is the receptacle for the distal micro-battery 40.

Another aspect of the invention is the open, shell-like appearance the device when it is in its assembled, pre-activation mode. The LED anode post 36 may be micro spot welded to the positive terminal of the micro-battery assembly 43 while the cathode post 38 remains un-welded and free standing. By pinching the fake nail tip 10 shut, by bringing the lower 22 and upper 24 shells together, the cathode post 38 makes electrical contact with the negative terminal of the micro-battery assembly 43 thus activating the fake nail tip 10.

Figure 10:
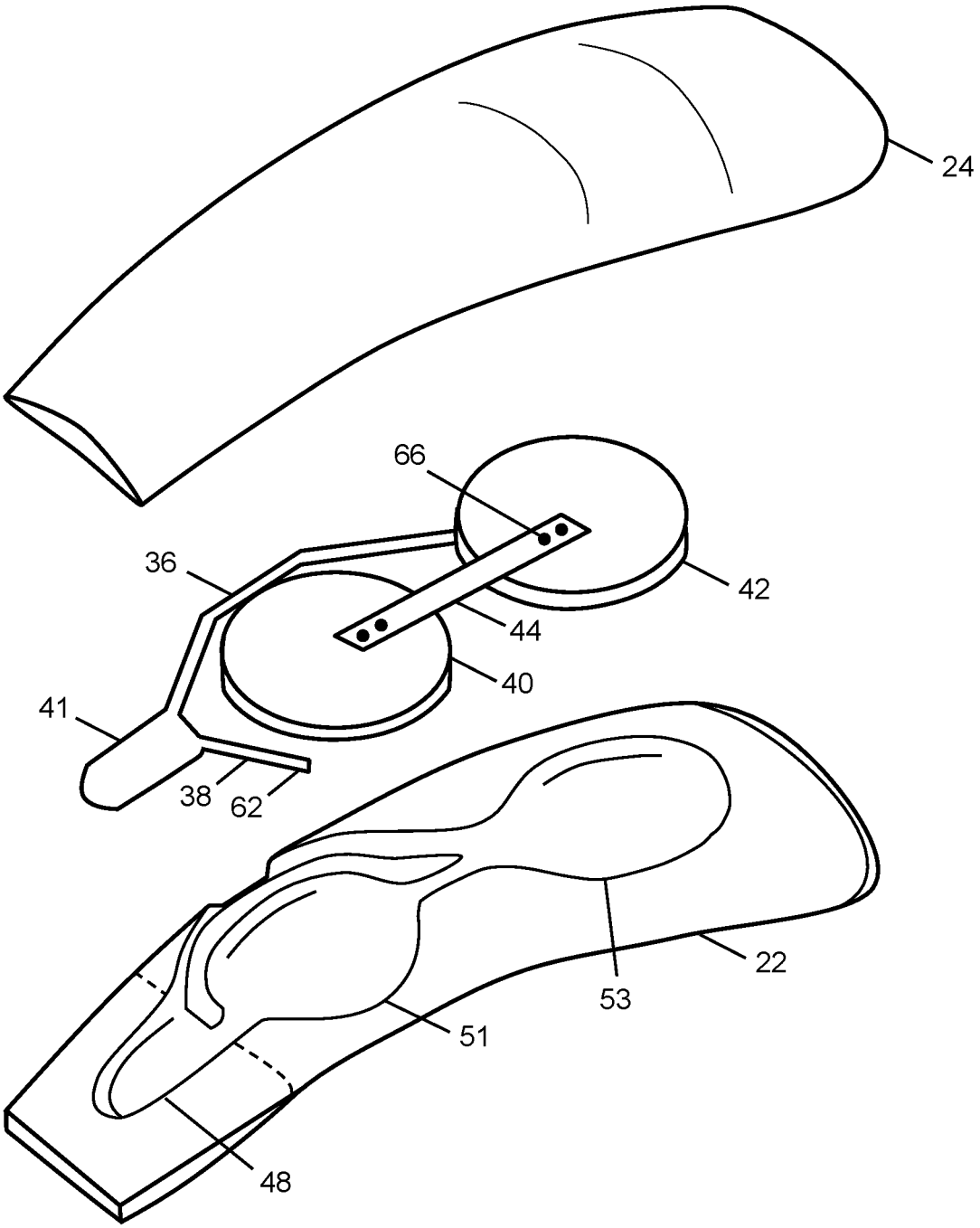
FIG. 10 is an exploded drawing showing the fake fingernail tip of FIG. 3 with its shells, the illumination device and the power sources, seen from above and the side in a perspective view.

Referring to FIG. 10, an exploded view is seen of the disassembled fake nail tip 10, in which the shells 22, 24 are not joined together. The micro-battery assembly 43 includes one micro-battery 40 connected to another 42 by an electrically conductive tab 44. The electrically conductive tab 44 is micro-spot welded 66 onto a metallic, terminal surface of each micro-battery. The cathode post 36 of the LED 41 is connected to the underside of micro-battery 42. The anode post 38 of the LED 41 will contact the underside of micro-battery 40 when the fake nail tip 10 is assembled and closed.

Figure 11:
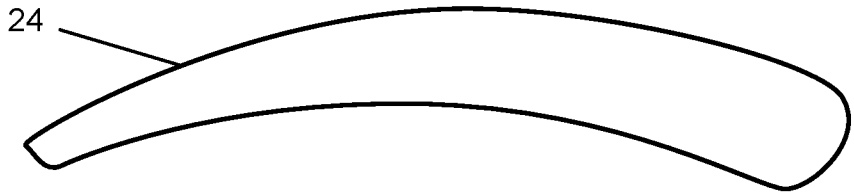
FIG. 11 is a drawing showing the assembled fake fingernail tip of FIG. 3 in its closed position, seen from the side.

Referring to FIG. 11, an illustration of the assembled fake nail tip 10 in its closed position is seen from the side, showing the upper shell 24 completely covering the lower shell 22.

Figure 12:
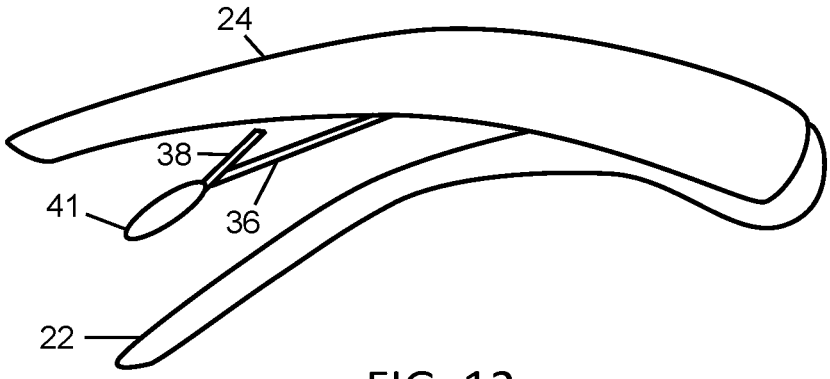
FIG. 12 is a drawing showing the assembled fake fingernail tip of FIG. 3 in its open position, seen from the side.

Referring to FIG. 12, there is shown an assembled fake nail tip 10 in its open position seen from the side, partially separated at its distal extremity in order to exhibit the LED 41, the anode post 36 and the cathode post 38, which connects the micro-battery assembly 43 and triggers the activation of the LED when the two shells 22, 24 are pinched together. The LED anode post 36 is micro spot welded to the positive terminal of the micro-battery assembly 35 while the cathode post 38 remains un-welded and free standing. In this state, the fake nail tip 10 is ready to be bonded to a wearer's fingernail.

In some embodiments, when the upper and lower shells are glued or otherwise fastened together, they form a hermetic seal to protect the micro-batteries from moisture.

Figure 13:
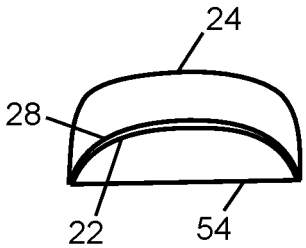
FIG. 13 is a drawing showing the assembled fake fingernail tip of FIG. 3 as seen from the front.

Referring to FIG. 13, there is shown an assembled fake nail tip 10 seen from the proximal end, with the upper shell 24 joined to the lower shell 22 and located in position by the lower shell flange 28. This figure also shows the convexity of the top surface of the upper shell 24. The flat thicker part of the distal section of the lower shell is exhibited at 54.

Figure 14:
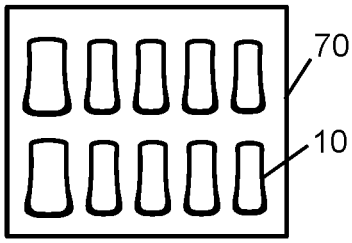
FIG. 14 is a schematic drawing of a kit of ten fake fingernail tips according to an embodiment of the present invention.

Referring to FIG. 14 a kit 70 of ten fake fingernail tips 10 is shown, for application to the two hands of a wearer.

C. Use

The fake nail tip 10 is intended to be worn for a night out on the town, a dance, a party or a performance, for example, and is intended to be removed within 72 hours of its application to a fingernail.

D. Variations

Other joining techniques may be used in other embodiments in place of the spot weld 26. Other locating techniques for locating the upper shell into position on the lower shell may be used.

The thickened, distal end of the lower shell may be formed as a lens, or it may include a lens.

The order of assembly may be different in other embodiments.

Different power sources may be used. Rechargeable power sources may be used, for example. The two shells may be reopenable after use, and the fake nail tip removed for a second or further use. Power sources may be mounted in different orientations.

Throughout the description, specific details have been set forth in order to provide a more thorough understanding of the invention. However, the invention may be practiced without these particulars. In other instances, well known elements have not been shown or described in detail and repetitions of steps and features have been omitted to avoid unnecessarily obscuring the invention. Accordingly, the specification is to be regarded in an illustrative, rather than a restrictive, sense.

It will be clear to one having skill in the art that further variations to the specific details disclosed herein can be made, resulting in other embodiments that are within the scope of the invention disclosed. In general, unless otherwise indicated, singular elements may be in the plural and vice versa with no loss of generality. Components may be divided into constituent components or combined into larger components. All parameters, dimensions, materials, and configurations described herein are examples only and actual choices of such depend on the specific embodiment. Accordingly, the scope of the invention is to be construed in accordance with the substance defined by the following claims.

The invention claimed is:

1. A fake nail tip for a human fingernail or toenail, comprising:
- a light source mounted in the fake nail tip;
- a power source mounted in the fake nail tip and connected to the light source;
- an upper shell and a lower shell between which the light source and the power source are located, wherein the upper shell and the lower shell are connected in their proximal regions to form a hinge; and
- a diffuser around the light source.

2. The fake nail tip of claim 1, wherein the light source is a light emitting diode (LED).

3. The fake nail tip of claim 2, wherein the LED is in a distal portion of the fake nail tip.

4. The fake nail tip of claim 1, wherein the fake nail tip encapsulates the power source.

5. The fake nail tip of claim 4, wherein the power source comprises one or more micro-batteries.

6. The fake nail tip of claim 1, wherein the upper shell conceals the power source from view.

7. The fake nail tip of claim 6, wherein at least one of the upper and lower shells defines a receptacle for the power source.

8. The fake nail tip of claim 6, wherein at least one of the upper and lower shells defines a receptacle for the light source.

9. The fake nail tip of claim 1, wherein when the upper and lower shells are closed together, they form a hermetic seal.

10. The fake nail tip of claim 1, configured to be bonded to a human nail when the upper and lower shells are open.

11. A fake nail tip for a human fingernail or toenail, comprising:
- a light source mounted in the fake nail tip;
- a power source mounted in the fake nail tip and connected to the light source;
- an upper shell and a lower shell between which the light source and the power source are located; and
- a diffuser around the light source;
- wherein the light source is switched off when the upper and lower shells are open and the light source is switched on when the upper and lower shells are closed.

12. The fake nail tip of claim 11, configured to be bonded to a human nail when the upper and lower shells are open.

13. The fake nail tip of claim 11, wherein the light source is switched on by an electrical contact being made between a terminal post of the light source and a terminal of the power source.

14. The fake nail tip of claim 11, wherein the upper shell and lower shell are connected in their proximal regions to form a hinge.

15. A fake nail tip for a human fingernail or toenail, comprising:
- a light source mounted in the fake nail tip;
- a power source mounted in the fake nail tip and connected to the light source;
- an upper shell and a lower shell between which the light source and the power source are located;
- a diffuser around the light source; and
- a flange on the lower shell that is configured to butt up against a cuticle of a wearer of the fake nail tip, wherein the upper shell butts up against the flange.

16. The fake nail tip of claim 15, wherein the upper shell and lower shell are connected in their proximal regions to form a hinge.

17. A method of illuminating a fake nail tip comprising the steps of:
- connecting an upper shell and a lower shell of the fake nail tip at proximal ends thereof to form a hinge;
- mounting a light source in the fake nail tip;
- mounting a power source in the fake nail tip;
- connecting the power source to the light source; and
- providing a diffuser in the fake nail tip around the light source.

18. The method of claim 17, wherein the upper and lower shells are connected before the light source and power source are mounted in the fake nail tip.

19. The method of claim 18, further comprising closing the shells together at distal ends thereof, thereby causing the light source to illuminate.

20. A kit of ten fake nail tips, each fake nail tip comprising a light source mounted in the fake nail tip;

a power source mounted in the fake nail tip and connected to the light source;

an upper shell and a lower shell between which the light source and the power source are located, wherein the upper shell and the lower shell are connected in their proximal regions to form a hinge; and a diffuser around the light source.

* * * * *